United States Patent [19]

Hanyu et al.

[11] Patent Number: 4,966,089

[45] Date of Patent: Oct. 30, 1990

[54] A SEWING MACHINE WITH A PIVOTABLE STITCH PATTERN TABLE

[75] Inventors: Susumu Hanyu; Masashi Ninomiya, both of Tokyo, Japan

[73] Assignee: Janome Sewing Machine Co. Ltd., Tokyo, Japan

[21] Appl. No.: 202,873

[22] Filed: Jun. 3, 1989

[30] Foreign Application Priority Data

Jun. 17, 1987 [JP] Japan ..... 62-91982[U]

[51] Int. Cl.[5] ..... D05B 3/02

[52] U.S. Cl. ..... 112/444; 112/258

[58] Field of Search ..... 112/445, 444, 258; 312/327

[56] References Cited

U.S. PATENT DOCUMENTS 2,848,963 8/1958 Johnson ..... 112/444
4,236,467 12/1980 Tanaka et al. ..... 112/444
4,323,023 4/1982 Beckerman et al. ..... 112/444
4,677,924 7/1987 Diener et al. ..... 112/444 X

*Primary Examiner*—Andrew M. Falik
*Attorney, Agent, or Firm*—Michael J. Striker

[57] ABSTRACT

A sewing machine has a front operating panel secured thereto and a pattern selecting device. A pivotable pattern table is mounted on the lower end of the operating panel and an inside surface of the pattern table has a pattern indicating device. The pattern table is rotatable from a closed position in which an outside surface is flush with the outside surface of the operating panel and into an open position in which its outside surface is resting on the sewing machine frame so that both the pattern indicating means and pattern selecting devices are simultaneously visible to a machine operator. The pattern table is pivotably supported on a shaft supported in a bearing located at the lower end of the operating panel.

3 Claims, 4 Drawing Sheets

A SEWING MACHINE WITH A PIVOTABLE STITCH PATTERN TABLE

FIELD OF THE INVENTION

The present invention relates to a sewing machine and more particularly relates to a pivotable stitch pattern table of a sewing machine.

BACKGROUND OF THE INVENTION

A sewing machine having many different stitch patterns stored therein to be selectively read out to be stitched is generally required to have a pattern indicating device and a pattern selecting device. A sewing machine has been known as shown in FIG. 7 in which a pattern indicating table 14 and a group of pattern selecting keys 13 are provided adjacent to each other on a front face of the sewing machine 11. Further a sewing machine has been known as shown in FIG. 8 in which a pattern indicating table 24 is provided on the underside of a top cover 15 of the sewing machine which is opened to disclose the pattern indicating table 24 while a group of pattern selecting keys 23 are provided on the front face of the sewing machine.

So many patterns, for example, more than one thousand patterns indicated on the front face of the machine will detract the outer appearance of the sewing machine. Further so many patterns indicated on the underside of the top plate 15 of the sewing machine will make it difficult for an operator to select a pattern because of the large distance between the pattern indicating table and the pattern selecting keys.

SUMMARY OF THE INVENTION

The present invention has been provided to eliminate the defects and shortcomings of the prior art. It is an object of the invention to provide a sewing machine having many different stitch patterns stored therein and including an operating panel having a pivotable pattern table located at a lower end thereof, the pattern table being pivotally moved between a closed position where the patterns indicated thereon are concealed and an opened position where the patterns are visible.

In short, the present invention comprises an operating panel provided on a front face of a sewing machine and having pattern selecting means provided thereon and a pivotable pattern table located at a lower end of the operating panel, wherein an inside surface of the pattern table supports pattern indicating means, the table being rotatable from a closed position where an outside surface thereof is flush with an outside surface of the operating panel to an open position where said outside surface is resting on a frame means and both the pattern indicating means and pattern selecting means are simultaneously visible to a machine operator, said table pivotably supported to swing between said closed and open position on a shaft, wherein said shaft is supported by a bearing located at the lower end of the operating panel, the bearing being located on the machine frame such that the distance between a center of the shaft and a sewing machine bed surface is greater than the distance between said shaft center and the outside surface of the pattern table.

DETAILED DESCRIPTION OF THE PREFERRED EMBODIMENTS

Figure 2:
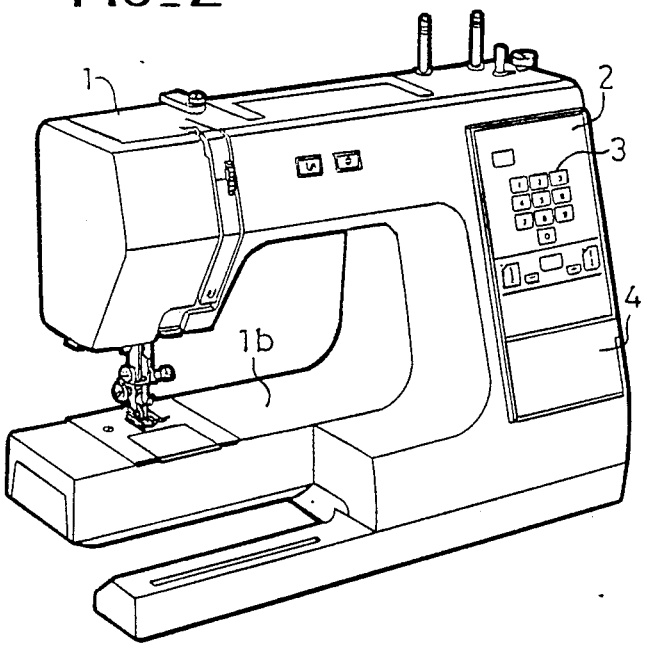
FIG. 2 is a perspective view of the sewing machine showing the pattern table in a closed position.

In reference to FIG. 2, a sewing machine has a machine frame 1 having an operating panel 2 provided on a front face thereof. The operating panel 2 has a group of pattern selecting keys 3 arranged at an upper part thereof, which are selectively operated to select any of patterns stored in a memory (not shown) of the sewing machine. A pivotable pattern table 4 is attached to a lower part of the operating panel 2.

Figure 1:
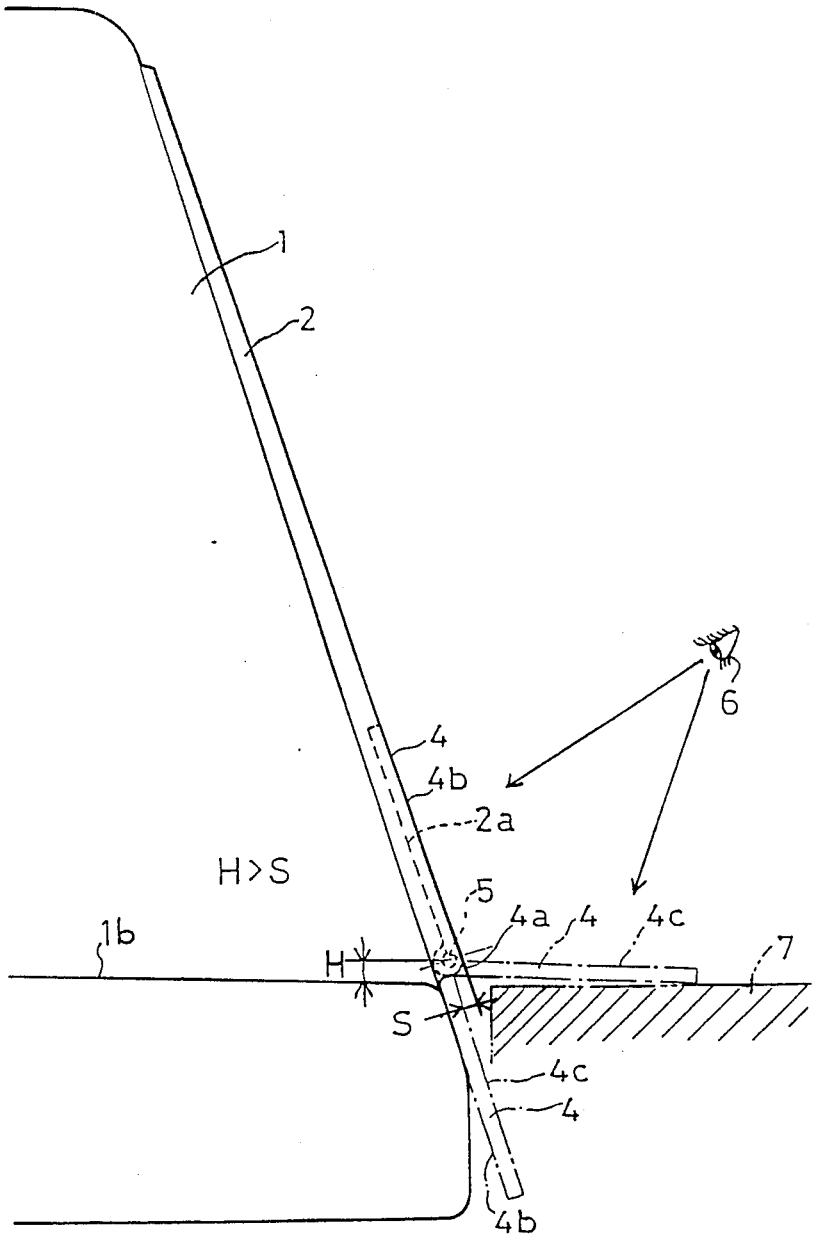
FIG. 1 is a side elevational view of a sewing machine showing a pivotable pattern table in an opened position.
Figure 3:
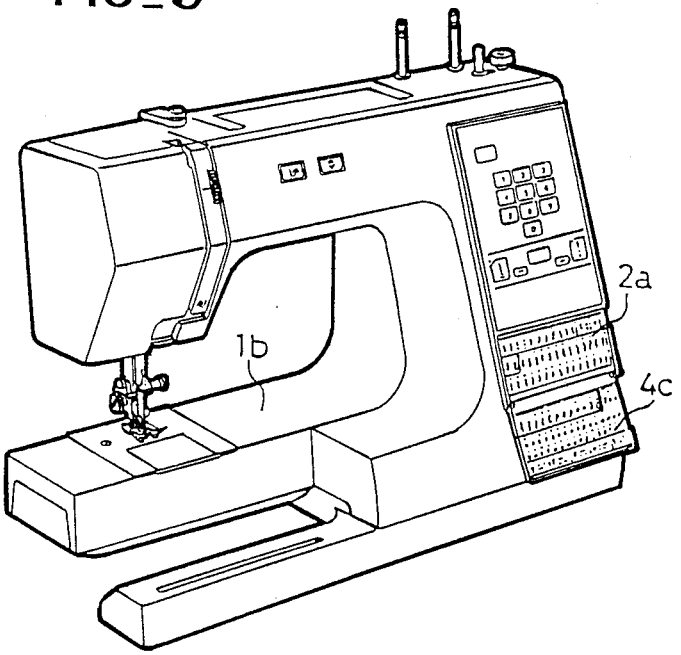
FIG. 3 is a perspective view of the sewing machine showing the pattern table opened and resting on a machine frame.
Figure 4:
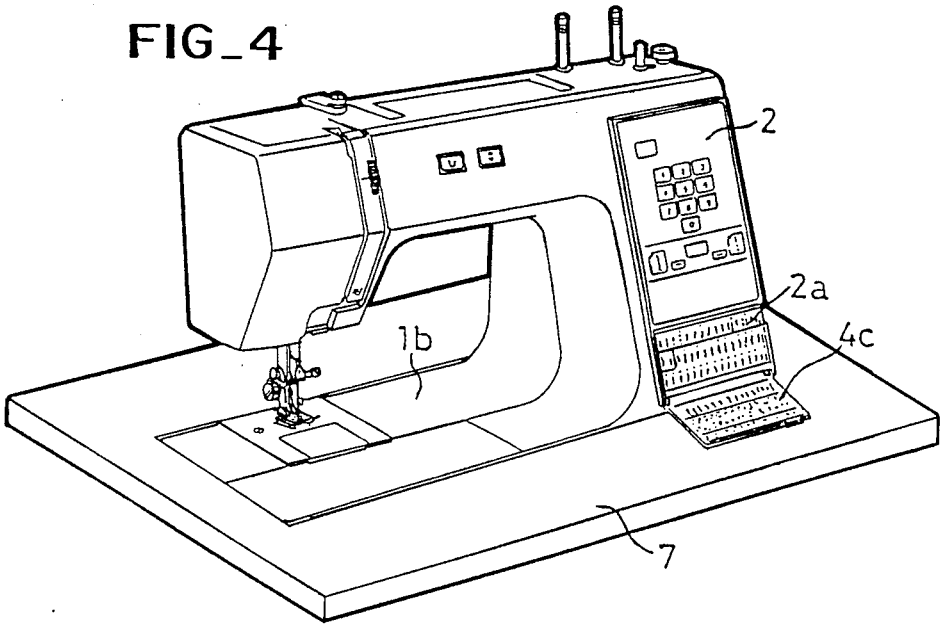
FIG. 4 is a perspective view of the sewing machine showing the pattern table opened and resting on a machine work table which is detacheable.
Figure 7:
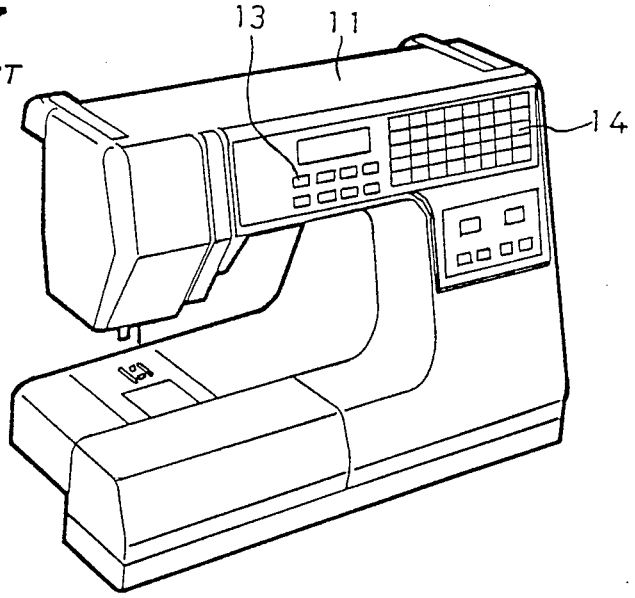
FIG 7 PRIOR ART
FIG. 7 is a perspective view of a sewing machine having a conventional pattern table.
Figure 8:
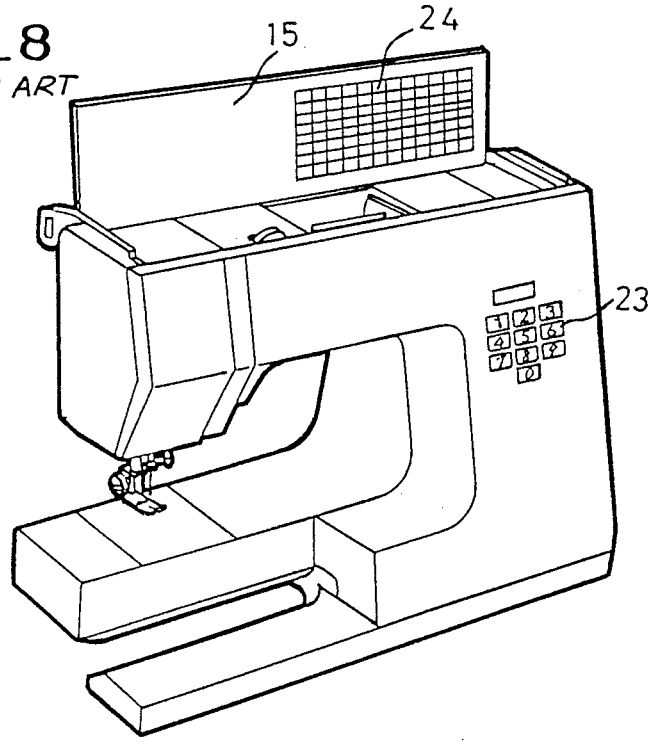
FIG 8 PRIOR ART
FIG. 8 is a perspective view of a sewing machine having another example of conventional pattern table.

As shown in FIG. 1, the pivotable pattern table 4 has a bearing **4*a* formed at one end thereof. The bearing 4*a* is supported on a rotation shaft 5 which is supported at a lower end of the operating panel, so that the pattern table may be pivotable between a closed position as shown in FIG. 2 and an opened position as shown in FIGS. 3 or 4. The lower part of the operating panel 2 is depressed as shown by a dotted line 2*a*, so that an outside surface 4*b* of the pattern table 4 is flush with an outside surface of the operating panel 2** when the pattern table is turned to the closed position.

As shown in FIGS. 3 or 4, a first group of many different stitch patterns to be selected by operation of the pattern selecting keys 3 are arranged on the depressed surface **2*a* at the lower part of the operating panel 2. Further the pivotable table has an inside surface 4*c* having a second group of many different stitch patterns arranged thereon to be selected by operation of the pattern selecting keys 3**.

As particularly shown in FIG. 1, the rotation shaft 5 of the pivotable table 4 is arranged on the machine frame 1 at a position above a machine bed surface **1*b* (FIGS. 2–4), so that a distance H is provided between the center of the rotation shaft 5 and the machine bed surface 1*b*. Further a distance S is provided between the center of the rotation shaft 5 and the outside surface 4*b* of the pattern table 4. It is further prescribed that the distance H is greater than the distance S, so that both the patterns on the frame surface 2*a* and the patterns on the inside surface 4*c* of the pattern table 4 may be simultaneously visible to a machine operator 6 especially when the pattern table is opened and rests on a machine work table 7**, that is, opened with more than an inner angle 90° provided as shown.

Further in reference to FIGS. 1, 3 and 4, since the machine work table 7 is detacheably attached to the sewing machine, the outside surface **4*b* of the pattern table 4 rests on the lower machine frame 1 if the pattern table is opened while the machine work table 7 is removed from the sewing machine. In any case, the patterns arranged on the panel surface 2***a* and on the pattern table surface 4*c* and the pattern selecting keys 3 on the operating panel 2 may be simultaneously visible to the machine operator 6.

Figure 5:
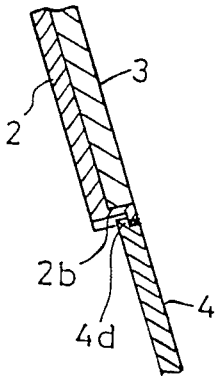
FIG. 5 is a sectioned side elevational view of the pattern table and an operating panel showing a relation therebetween when the pattern table is closed.
Figure 6:
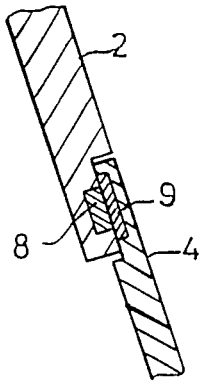
FIG. 6 is a sectioned side elevational view of a pattern table and an operating panel showing another embodiment of relation therebetween when the pattern table is closed.

In the closed position of the pattern table 4, a cutout part 4*d* formed at the opposite end of the pattern table 4 is snappingly engaged to a counter-cutout 2*b* formed on the operating panel 2 as shown in FIG. 5. Otherwise as shown in FIG. 6, the pattern table 4 may have a magnetizable substance 9 embeded in the opposite end thereof while the operating panel 2 has a magnet 8 embeded therein, so that the pattern panel 2 is held in the closed position.

As stated above, according to the present invention, many stitch patterns are arranged on the operating panel 2 and on the pattern table 4 pivotably connected to the operating panel 2 which has a group of pattern selecting keys 3 arranged thereon adjacent to these stitch patterns.

It is therefore very easy for a machine operator to selectively operate the pattern selecting keys 3 while observing the stitch patterns on the operating panel 2 and the pivotable pattern table which is turned to the opened position in both cases where the machine work table is or is not used. Further the pivotable pattern table 4 may be turned back to the closed position to conceal all of the stitch patterns when the machine is not used.

What is claimed is:

1. A sewing machine comprising a machine frame having a front face, an operating panel having a lower end, said operating panel being secured to said front face of said machine frame, a pattern selecting means, a pivotable pattern table located at said lower end of said operating panel below said pattern selecting means and having both an inside and an outside surface and stitch pattern indicating means supported on said inside surface of said pattern table, said pattern table being pivotable from a closed position in which said outside surface of said pattern table is flush with an outside surface of the operating panel and into an open position in which said pattern table outside surface is resting on said machine frame so that both said stitch pattern indicating means and said stitch pattern selecting means are simultaneously visible to an operator.

2. A sewing machine according to claim 1, further comprising a bearing and a shaft on which said pattern table is supported pivotally, said bearing being located at the lower end of the operating panel on the machine frame such that a distance between a center of the shaft and a sewing machine bed surface is greater than a distance between said shaft center and the outside surface of the pattern table.

3. A sewing machine including a pivotable pattern table located at a lower end of a machine operating panel, said panel including pattern selecting means, wherein an inside surface of the pattern table supports pattern indicating means, the pattern table being rotatable from a closed position in which an outside surface thereof is flush with an outside surface of the operating panel and into an open position in which said outside surface is resting on a machine frame and both the pattern indicating means and pattern selecting means are simultaneously visible to a machine operator, said pattern table being pivotably supported to swing between said closed and open position S on a shaft, wherein said shaft is supported by a bearing located at the lower end of the operating panel, the bearing being located on the machine frame such that a distance between a center of the shaft and a sewing machine bed surface is greater than a distance between said shaft center and the outside surface of the pattern table.

* * * * *